US005722369A

United States Patent [19]

Weippert

[11] Patent Number: 5,722,369

[45] Date of Patent: Mar. 3, 1998

[54] IDLING CONTROL MEANS FOR A FUEL INJECTION PUMP FOR INTERNAL COMBUSTION ENGINES

[75] Inventor: Willi Weippert, Bondorf, Germany

[73] Assignee: Robert Bosch, GmbH, Stuttgart, Germany

[21] Appl. No.: 693,203

[22] PCT Filed: Nov. 10, 1995

[86] PCT No.: PCT/DE95/01554

§ 371 Date: Aug. 5, 1996

§ 102(e) Date: Aug. 5, 1996

[87] PCT Pub. No.: WO96/18027

PCT Pub. Date: Jan. 13, 1996

[30] Foreign Application Priority Data

Dec. 3, 1994 [DE] Germany ..... 44 43 114.7

[51] Int. Cl.[6] ..... F02D 1/04

[52] U.S. Cl. ..... 123/373

[58] Field of Search ..... 123/373, 367, 123/449

[56] References Cited

U.S. PATENT DOCUMENTS

| | | | |
|---|---|---|---|
| 4,615,317 | 10/1986 | Bofinger et al. | 123/373 |
| 4,703,730 | 11/1987 | Eheim et al. | 123/373 |
| 4,913,115 | 4/1990 | Konrath | 123/373 |
| 4,920,938 | 5/1990 | Schwarz et al. | 123/449 |
| 4,987,875 | 1/1991 | Hofer et al. | 123/373 |

*Primary Examiner*—Thomas N. Moulis

*Attorney, Agent, or Firm*—Edwin E. Greigg; Ronald E. Greigg

[57] ABSTRACT

A fuel injection pump that has both a governor spring and an adjustable idling spring, suspended in a manner structurally connected to the housing. The setting of the spring is adjustable between a minimum idling setting and a maximum idling setting via a coupling arrangement, in accordance with an adjustment of an adjusting lever.

9 Claims, 2 Drawing Sheets

IDLING CONTROL MEANS FOR A FUEL INJECTION PUMP FOR INTERNAL COMBUSTION ENGINES

PRIOR ART

The invention is based on a fuel injection pump for internal combustion engines. One such fuel injection pump, known from European Patent Disclosure EP-A-0 451 151 has a T-shaped control lever on the outside of the pump housing that is joined to an adjusting shaft that leads to the idling spring control lever in the interior of the pump housing and is pivotable about the adjusting shaft as a pivot axis. A Bowden cable is pivotably connected to the base of the T-shaped control lever and is actuated by a pneumatic control motor as a function of operating states of the engine. Independently of this control lever in the known fuel injection pump, the adjusting lever is provided on the outside of the housing of the fuel injection pump; it is adjustable between two stops and is actuated by a so-called throttle control cable for controlling the torque output of the engine.

The control lever is actuated by the control motor, especially to increase the idling rpm, when additional units of the engine are turned on.

ADVANTAGES OF THE INVENTION

The fuel injection pump according to the invention has the advantage over the prior art that because of the coupling of the control lever to the adjusting lever, the idling can be controlled within certain operating ranges specified by the setting of the adjusting lever. Particularly in the critical low-rpm range, a desired fuel injection quantity or torque output can be attained, and as a result the running behavior of the engine can be improved in such specified critical ranges.

As a result of the features set forth herein, a favorable arrangement for attaining the idling adjustment is obtained, which can optionally be retrofitted into an existing fuel injection pump where space is tight. With a further feature of the invention, the onset point of the intervention into the idling can advantageously vary over the course of adjustment of the adjusting lever and can be adapted to special characteristics of the associated engine. Other options for adaptation are provided, by which particularly where the pivot planes of the adjusting lever and control lever are offset by 90° from one another, a favorable, space-saving arrangement is created.

BRIEF DESCRIPTION OF THE DRAWINGS

One exemplary embodiment of the subject of the invention is shown in the drawing and will be described in detail below.

DETAILED DESCRIPTION OF THE DRAWINGS

Figure 1:
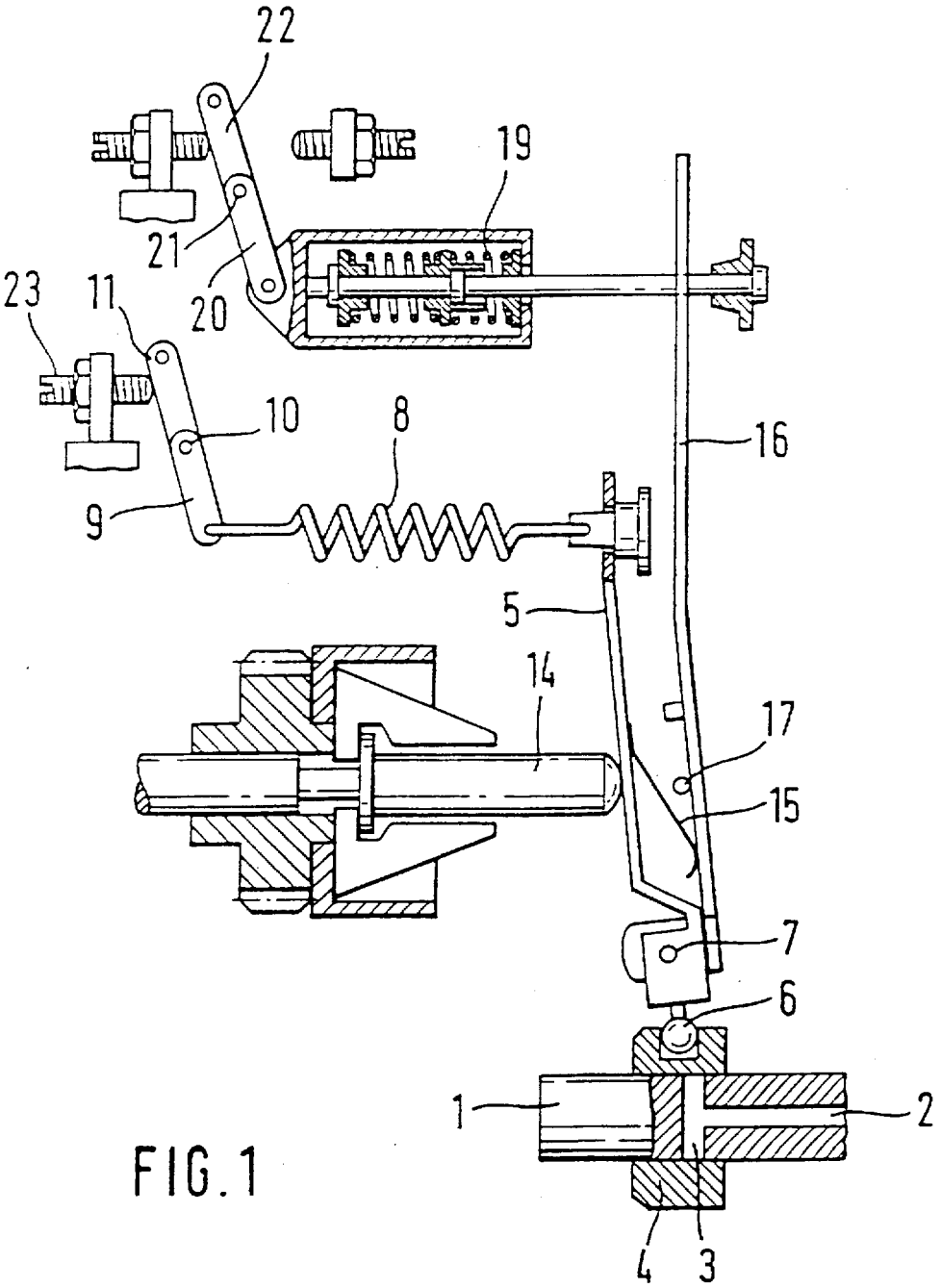
FIG. 1 shows a schematic arrangement of a governor spring, idling spring and governor levers with a quantity adjusting device of a fuel injection pump.

In the interior of a fuel injection pump, of the kind known from EP-A-0 451 151, a pump piston 1 is disposed in a housing bore; although not shown here, it defines a pump work chamber in the housing bore, is driven both to reciprocate and to rotate, and in its motion out of the pump work chamber, it feeds the fuel previously introduced to one of a plurality of injection lines, determined by its rotary position, at injection pressure. The termination of the supply stroke of the pump piston at high pressure is effected by opening a relief conduit 2, which begins at the pump work chamber in the pump piston 1, extends via a radial bore 3, and emerges at the circumference of the pump piston and discharges into the suction chamber surrounding the pump chamber there; the suction chamber is filled with fuel at low pressure, and from it, the pump work chamber is supplied with fuel upon the intake stroke of the pump piston. The relief of the relief conduit 2 via the radial bore 3 takes place whenever the pump piston, in the course of its supply stroke, which in the drawing is toward the right, departs from the position overlap with a quantity adjusting device 4, in the form of an annular slide, that can be slipped tightly over the pump piston 1.

Figure 2:
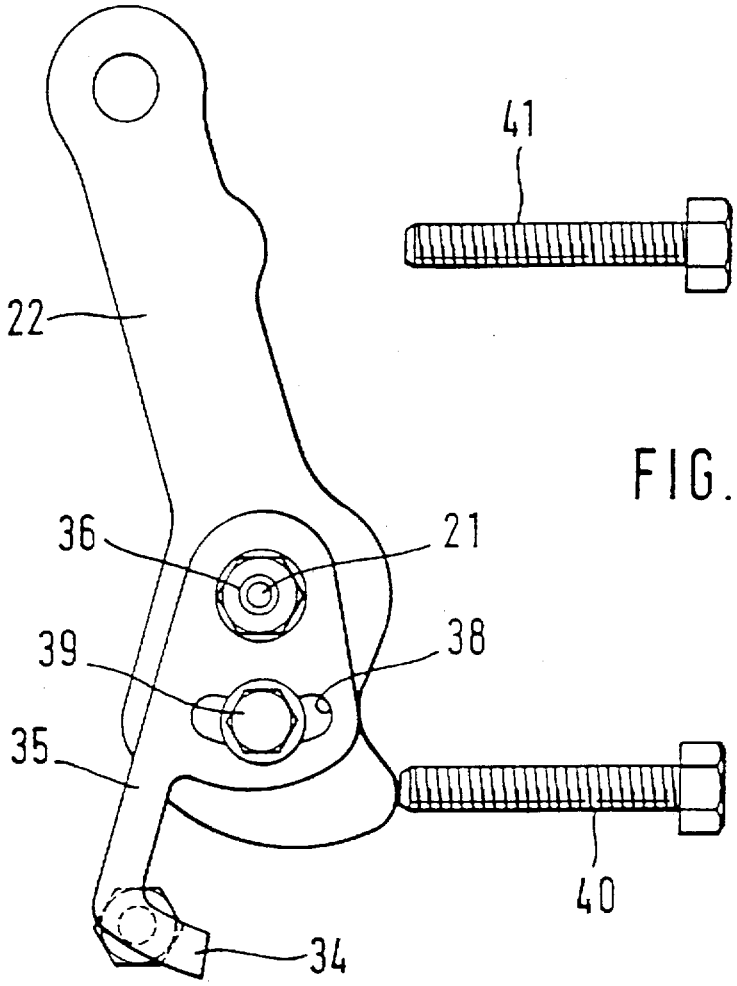
FIG. 2 shows the exemplary embodiment of the invention with coupling of a control lever to an adjusting lever of the fuel injection pump via a cam course.

The quantity adjusting device 4 is put into its position that determines the fuel injection quantity per pump piston stroke by means of a governor lever 5, and the adjusting device is coupled to the governor 5 via a coupling head 6. The governor lever 5 is pivotable about a shaft 7, specifically counter to the force of an idling spring 8 suspended by one end from the governor lever 5 and with its other end secured to an idling spring control lever 9. This lever 9 is connected via a shaft 10, which leads through the pump housing to the outside in a manner not further shown, to a control lever 11, which is shown in further detail in FIG. 2. Also engaging the governor lever 5 is a centrifugal control 14, by which the governor lever, with increasing rpm and thus increasing force, is pivoted about the shaft 7 counter to the force of the idling spring 8. The centrifugal control is an rpm sensor, which generates an rpm-dependent force, but instead of this mechanical rpm sensor other types of rpm sensors may also be used, such as hydraulically or electromechanically operated sensors. By means of the centrifugal control 14, the governor lever is pivoted, optionally overcoming an additional starting spring 15 which when the fuel injection pump is stopped assures a starting position of the quantity adjusting device 4 and thus assures an increased fuel injection quantity upon starting, until the governor lever 5 comes to rest against a tension lever 16, whose final position is determined by a stop 17 structurally connected to the housing. This tension lever is likewise pivotable about the shaft 7, and pivotably connected to its end is a governor spring 19 which on its other end is in turn secured to a setting lever 20. The setting lever 20 is actuated via a control shaft 21 that leads through the housing to the outside; an adjusting lever 22, shown in further detail in FIG. 1, is secured to the outer end of the control shaft.

At low-load operation, with the aid of the centrifugal control 14 and at a given setting of the idling spring prestressing via the control lever 11 and the idling spring control lever 9, the idling rpm is determined. Once the prestressing of the idling spring 8 has been overcome, the governor lever 5 pivots outward and displaces the annular slide 4 or quantity adjusting device downward, thus reducing the fuel injection quantities. An operation under load, the governor lever 5 rests fully on the tension lever 16; particularly at full-load operation, the tension lever 16 is held against the full-load stop 17 by the setting of the governor spring 19, until the maximum cutoff rpm is reached, at which time the prestressed governor spring 19 is compressed and the tension lever 16 together with the governor lever 5 is pivoted outward, clockwise in terms of the drawing. The fuel injection quantity is thus once again reduced.

The governor spring 19 in the example discussed is embodied as a compression spring in cooperation with a compensation spring, both of which are accommodated in a spring capsule, which initially, when only slight force is exerted on the governor spring unit, is located stably as a fixed transmission element between the setting lever 20 and tension lever 16, in such a way that upon the adjustment of the setting lever 20, various load positions can be set beginning at the full-load position of the tension lever 16. Not until the maximum rpm is reached is the force that acts upon the prestressed governor spring unit 19 so great that the prestressing force of the fastened spring is overcome and the tension lever 16 can move independently of the position of the setting lever 20.

Figure 3:
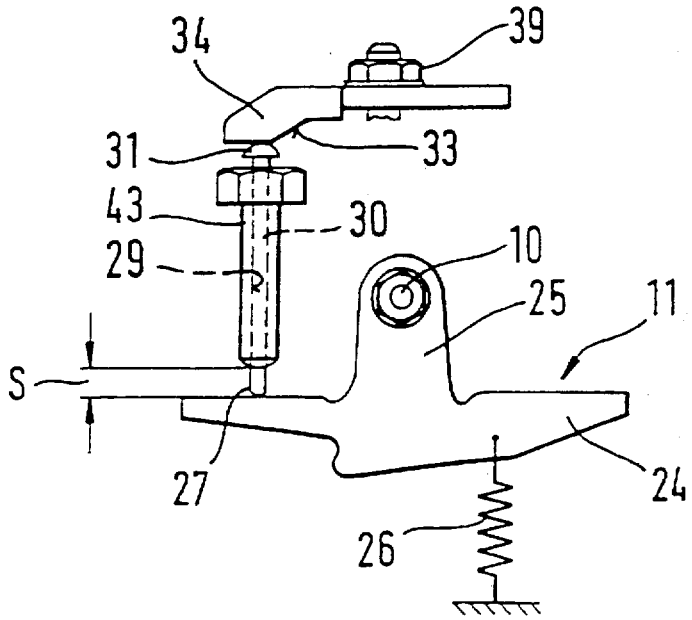
FIG. 3 shows a view offset by 90° of the arrangement shown in FIG. 1.

While in previous pumps the idling rpm was initially firmly set with the aid of the idling spring 8 and the control lever 11, because this lever was fixed by a stop 23 that is adjustable, now the idling rpm is intended to be variable within predetermined limits by increasing the spring tension of the idling spring 8. As shown in FIG. 3, the control lever 11 has a T-shaped configuration, with a "T" crossbar 24 and a T stem 25, which is joined in the region of its base to the end of the shaft 10.

By means of an additional restoring spring 26 located on the outside, the control lever 11 is acted upon in such a way that it seeks to come into contact, with one arm of its T bar 24, with a stop 27.

This stop is the end of a pin 30 or bolt, which is guided in a guide bore 29 and which with its other, preferably ball-headed end 31 is in contact with a cam course 33. This cam course is part of a cam 34, which is embodied on an adjustable part 35. This latter part rests flatly on the face end of the adjusting lever 22, which end is offset by 90° from the pivoting plane of the control lever and the axis of the pin 30, and this part is joined to the aforementioned face end via a separable connection, in particular a screw connection 36 on the control shaft 21. The part 35 is pivotable about this connection within the limits of an angular range defined by the length of an oblong slot in the part 35. A screw 39 is screwed through the oblong slot into the adjusting lever 22, and by means of this screw the part 35 can be fixed in a defined rotary position relative to the adjusting lever 22. Adjustable stops 40 and 42, for the smallest and the largest load setting, are associated with the adjusting lever to limit its pivoting motion.

The cam 34 extends longitudinally of the pivoting course of the part 35, which moves together with the adjusting lever 22 in the region between the stops 40 and 41, in such a way that the head 31 of the pin 30 remains in constant contact with the cam course 33 under the influence of the restoring spring 26, which acts upon the pin 30 via the control lever and one arm of the T crossbar 24. It is thus accomplished that upon a pivoting motion of the adjusting lever 22, the control lever 11 is pivoted within the limits of the adjusting motion of the pin 30 that follows along the moving cam course 33.

Depending on the design of the cam courses 33, a coupling of the setting of the idling spring with the load specified by the adjusting lever 22 is achieved. The association of the cam course 33 with the location of the adjusting lever 22 can be varied. The guide bore 29 for the pin 30 is advantageously formed by a lengthwise bore through a screw 43 that is screwed into a housing part of the fuel injection pump. The face end of the screw 43 can act as an additional stop for the maximum adjustment of the control lever, which maximum adjustment results from the possible travel of the pin 30 that at maximum protrudes out of the screw 43 by the distance "S".

Because with the aid of the restoring spring 26 the control lever 11 is in constant contact with the stop 27 or the pin 30, this pin 30 represents the stop that determines the setting of the control lever, which shifts within the limits of the given characteristics of the cam course 35. This stop thus sets the minimum setting for the idling spring prestressing. The maximum setting is limited by the extent of protrusion "S" of the screw 43.

In this case, the control lever 11 may also be embodied as a simple one-armed lever, with a correspondingly suitable attachment of the restoring spring 26 that presses this lever arm against the stop 27. The T-shaped three-armed lever shown in FIG. 3 is then used only if besides the adjustable stop 27 one additional stop is also considered to be necessary.

The foregoing relates to preferred exemplary embodiments of the invention, it being understood that other variants and embodiments thereof are possible within the spirit and scope of the invention, the latter being defined by the appended claims.

What is claimed is:

1. A fuel injection pump for internal combustion engines, comprising a housing, a fuel injection quantity adjusting device (4) which is actuated by means of a governor lever (5), said governor lever is adjustable counter to a force of a governor spring (19) as a function of an rpm-dependently formed force, the governor spring (19) being disposed between a tensioning lever (16) and a setting lever (20) which is adjustable via a control shaft supported in stationary fashion and on whose end an adjusting lever (22) is secured, an idling spring (8) that is coupled to the governor lever (5) and is fastened between the governor lever and an idling spring control lever (9) secured to a shaft supported in a manner structurally attached to the housing, the idling spring control lever being adjustable by means of a control lever (11), connected to the shaft (10), a pivoting motion of said control lever is limited by a stop (23, 24, 33, 36) and is settable by means of an actuating device as a function of engine operating parameters, the actuating device comprises a restoring spring (26), which engages the control lever (11), and a coupling arrangement, by means of which the control lever (11) is tensionally coupled to the adjusting lever (22), in such a way that the control lever (11) follows along with an adjustment of the adjusting lever (22).

2. The fuel injection pump of claim 1, in which the coupling arrangement comprises a displaceably supported pin (30), which under an influence of the restoring spring (26) is fastened between the control lever (11) and a cam course part (33) that is moved by means of the adjusting lever (22).

3. The fuel injection pump of claim 2, in which the cam course (33) is embodied on an arm (35) that is supported rotatably and fixably on the adjusting lever (22).

4. The fuel injection pump of claim 3, in which the cam course part (33) is secured together with the adjusting lever pivotably to an end of the control shaft (21) and is additionally fixable on the adjusting lever (22), in a specific relationship with said adjusting lever, via an oblong slot and screw connection (38, 39).

5. The fuel injection pump of claim 4, in which the cam course part (33) rises vertically from a pivoting plane of the adjusting lever, and a pin (30) and the pivoting plane of the control lever (11) are disposed vertically to the pivoting plane of the adjusting lever (22).

6. The fuel injection pump of claim 2, in which the pin (30) and a control screw (43) act as an adjustable stop (27) of the control lever (11).

7. The fuel injection pump of claim 3, in which the pin (30) and a control screw (43) act as an adjustable stop (27) of the control lever (11).

8. The fuel injection pump of claim 4, in which the pin (30) and a control screw (43) act as an adjustable stop (27) of the control lever (11).

9. The fuel injection pump of claim 5, in which the pin (30) and a control screw (43) act as an adjustable stop (27) of the control lever (11).

* * * * *